US009849503B2

(12) United States Patent
Lauener et al.

(10) Patent No.: US 9,849,503 B2
(45) Date of Patent: Dec. 26, 2017

(54) TRANSPORT DEVICE

(71) Applicant: Lamec AG, Recherswill (CH)

(72) Inventors: Martin Lauener, Winistorf (CH); Heinrich Lauener, Neuheim (CH)

(73) Assignee: LAMEC AG (CH)

( * ) Notice: Subject to any disclaimer, the term of this patent is extended or adjusted under 35 U.S.C. 154(b) by 266 days.

(21) Appl. No.: 14/784,425

(22) PCT Filed: Apr. 16, 2013

(86) PCT No.: PCT/CH2013/000063
§ 371 (c)(1),
(2) Date: Oct. 14, 2015

(87) PCT Pub. No.: WO2014/169397
PCT Pub. Date: Oct. 23, 2014

(65) Prior Publication Data

US 2017/0157666 A1 Jun. 8, 2017

(51) Int. Cl.
*B22D 11/06* (2006.01)
*B22D 11/128* (2006.01)

(52) U.S. Cl.
CPC ..... *B22D 11/0688* (2013.01); *B22D 11/0608* (2013.01); *B22D 11/1284* (2013.01)

(58) Field of Classification Search
CPC ..... B22D 11/0608; B22D 11/0688
(Continued)

(56) References Cited

U.S. PATENT DOCUMENTS 3,570,586 A 3/1971 Lauener
3,605,868 A 9/1971 Giadorou
(Continued)

FOREIGN PATENT DOCUMENTS

EP 0 317 285 B1 4/1991
JP S61-82954 A 4/1986
(Continued)

OTHER PUBLICATIONS

Russian Federation Decision on Grant, date Apr. 6, 2017, issued in corresponding Russian Patent Application No. 2015148774/02(075053). English Translation. Total pp. 18.
(Continued)

*Primary Examiner* — Kevin E Yoon
(74) *Attorney, Agent, or Firm* — Ostrolenk Faber LLP

(57) ABSTRACT

A transport device, in particular, for transporting cooling blocks (5) in a casting machine with caterpillar mold, wherein the transport device includes: a plurality of roller elements (4), which circulate endless in a caterpillar-like manner on a circulating path U and is drivable by a drive device (33); at least two parallel guide paths (20), each of which includes one or more roller running surfaces (12*a*, 12*b*) and each of which extends over the entire circulating path U; wherein each roller element (4) includes a roller element body (34), which has a first end (35) and a second end (36) in the direction of circulation; each roller element (4) includes at least one roller (10) respectively in the area of the first end (35) and in the area of the second end (36); and the rollers (10) situated in the area of the first end (35) of roller element body (34) roll on roller running surfaces (12*a*, 12*b*) different from those of the rollers (10) situated in the area of the second end (36) of the roller element body (34).

30 Claims, 10 Drawing Sheets

(58) Field of Classification Search
USPC ..... 164/429, 430, 479, 481, 482
See application file for complete search history.

(56) References Cited

U.S. PATENT DOCUMENTS

| | | | | |
|---|---|---|---|---|
| 4,331,195 | A * | 5/1982 | Webber | B22D 11/0608 164/430 |
| 4,909,304 | A | 3/1990 | Sato et al. | |
| 5,645,159 | A | 7/1997 | Luginbühl et al. | |
| 5,868,193 | A | 2/1999 | Luginbühl et al. | |
| 5,873,404 | A | 2/1999 | Luginbühl et al. | |
| 5,878,805 | A | 3/1999 | Witschi et al. | |
| 5,924,474 | A | 7/1999 | Luginbühl et al. | |
| 6,076,657 | A | 6/2000 | Luginbühl et al. | |
| 6,192,973 | B1 | 2/2001 | Schwerdtfeger | 164/441 |
| 6,325,204 | B1 | 12/2001 | Zürcher | |
| 7,156,147 | B1 | 1/2007 | Wood | 164/431 |
| 2002/0053499 | A1 | 5/2002 | Zurcher | |

FOREIGN PATENT DOCUMENTS

| | | | |
|---|---|---|---|
| JP | S63-149047 | A | 6/1988 |
| JP | H01-130851 | A | 5/1989 |
| JP | H09-511185 | A | 11/1997 |
| RU | 2160176 | C2 | 12/2000 |
| RU | 2346787 | C2 | 2/2009 |
| WO | WO 95/26842 | A1 | 10/1995 |
| WO | WO 2005/068108 | A1 | 7/2005 |

OTHER PUBLICATIONS

International Search Report dated Apr. 9, 2014 issued in corresponding International patent application No. PCT/CH2013/000063.

Office Action dated Jan. 24, 2017 in corresponding Japanese Patent Application No. 2016-507963 (with partial English language translation)(total 6 pages).

* cited by examiner

TRANSPORT DEVICE

CROSS REFERENCE TO RELATED APPLICATIONS

The present application is a 35 U.S.C. §371 National Phase conversion of PCT/CH2014/000063, filed Apr. 16, 2013, the disclosure of which is incorporated herein by reference. The PCT International Application was published in the German language.

TECHNICAL FIELD OF THE INVENTION

The present invention relates to a transport device, in particular, for transporting cooling blocks in a casting machine with caterpillar mold according to the preamble of patent claim 1.

BACKGROUND OF THE INVENTION

Transport devices with endless belts or chains are commonly used in technology as conveyors. A further application of such transport devices can be found in the foundry industry in which, for example, the rolling members of the device may include a rolling member body having one or more cooling blocks so that the rolling members form the cooling elements of a casting caterpillar.

Casting devices of this type are known as so-called caterpillar-type mold casting machines and are, according to American terminology, called "machines with caterpillar mold" and also "block casters."

By way of a drive, the blocks circulate as endless caterpillars around a machine body, one design including two machine bodies opposite each other which are positioned in such a way that the distance between the walls facing one another in the mold corresponds to the thickness of the strand to be cast, taking into consideration the shrinking of the molten materials as they solidify.

Another design is distinguished by the fact that the machine includes only one machine body around which a caterpillar circulates, and the melt is poured onto the caterpillar where it continuously solidifies into a strand. In this instance, the solidified strand is preferably covered by a gas shrouding to prevent unwanted oxidation on the free upper side of the solidified melt.

Methods and devices for this purpose have already been developed in the penultimate century and the last century. Reference is made to the books by E. Hermann, "Handbuch des Stranggiessens" ("Handbook on Continuous Casting"), 1958, and "Handbook on Continuous Casting," 1980 (Aluminium Verlag Düsseldorf). Thus, among other types, casting machines were also designed in which the casting mold, where the melt solidifies, is formed by strung-together metal blocks extending over the width of the casting mold.

In order to minimize friction between the solidifying casting material and the casting mold, the blocks move along with the solidifying strand at the same speed until they reach the end of the casting mold, where they are detached from the strand and are directed, for example, by means of chain wheels or arcuate running paths to the rear of the machine body and are, after undergoing a change of direction once more, guided back to the inlet of the casting mold.

A casting machine, the cooling elements of which form the wall of a casting mold on the straight portions of the casting caterpillars, is known from WO 2005/068108 LAMEC. This known casting machine includes two casting caterpillars, each of the two casting caterpillars forming a wall of the casting mold and each casting caterpillar being made up of a plurality of endless cooling blocks connected to one another. The cooling blocks are installed on carrier elements, which are mounted on chains and thus are movably connected to one another like links of a chain. For this purpose, the cooling blocks hold, by way of stationary magnets, the supporting members on the chains, from which they would fall down because of gravity. The chain links are provided at their junctions with rollers rolling on guide paths. This known molding machine, however, has the disadvantage that, in particular, significant friction losses are caused by the chain joints under load owing to the caterpillar drive.

SUMMARY OF THE INVENTION

In this instance, the object of the invention is to remedy this circumstance. The object of the invention is to create a transport device, the roller elements of which enable a low-friction, uninterrupted run on the entire circulating path and, in particular, in the deflection arcs and when transitioning between the straight sections and the deflection arcs.

The invention solves this problem by a transport device which has the characteristics of claim 1.

The advantages achieved by the invention are substantially to be seen in that:

Since each roller element by means of rollers is individually directed in the guide paths on the circulating path and, thus, may not fall down from the guide paths because of gravity, the roller elements do not have to be coupled to one another in the direction of the circulation movement. For this reason, a low-friction, uninterrupted run of the roller elements on the circulating path and, in particular, in transitions and on the deflection arcs is enabled; and The detached roller elements may be deposited or stacked on specially designed depositing stations for the reception of the roller carriers without the rolling elements tipping.

Additional advantageous embodiments of the invention may be commented upon as follows:

In one specific embodiment, the roller elements are loose relative to one another in the direction of the circulation movement. For this reason, the advantage may be achieved that applying and removing the roller elements may occur individually or in assemblies without having to loosen connections between the individual roller elements because the roller elements succeeding one another on the circulating path are not coupled together like the links of a chain. Particularly when using the transport device in casting machines with caterpillar mold, the roller elements designed as cooling elements may be placed on and removed from the machine with minimal time effort.

In another embodiment, joint bearings are situated in the area of the first end and/or in the area of the second end of the roller element body, wherein in each case at least two rollers are attached to a joint bearing.

Preferably, the joint bearings are rotatably attached to the roller element body by way of joint axles, wherein the joint axles are perpendicularly positioned to a center plane of the transport device defined by the circulating path U.

In a further embodiment, the rollers respectively include a roller axle, wherein the roller axles are fixedly attached to the roller element body.

In another embodiment, the roller element bodies measured in the direction of circulation have a maximum length "L" and immediately adjacent roller elements may be positioned on the first and second guide path in such a manner that the geometric axes of the roller axles or of the joint axles of the rollers or joint bearings, which are disposed in the area of the first ends of two adjacent roller elements, may be substantially adjusted to a distance, which corresponds to the maximum length "L".

In yet another embodiment, the geometrical axes of the roller axles or of the joint axles of the rollers or joint bearings disposed in the area of the first ends lie in a plane orthogonal to the direction of the circulation movement, which plane is defined by the first end of the respective roller element body.

In a further embodiment, the geometrical axes of the roller axles or of the joint axles of the rollers or joint bearings disposed in the area of the second ends lie in a plane orthogonal to the direction of the circulation movement, having a distance to the plane defined by the first ends of the respective roller element body which is substantially equal to or greater than the length "L". In this way, the advantage may be achieved that the axle distance substantially corresponds to the cooling block length measured in the direction of circulation, as a result of which a kinematically optimal run of the cooling blocks on the entire circulating path is enabled.

Preferably, the geometrical axes of the roller axles or of the joint axles, which are situated at the first and second ends facing each other of two roller elements adjacent in the direction of the circulation movement, are substantially coaxial. The coaxial arrangement of the geometrical axes of the rollers of two adjacent roller elements, which are situated at the ends of the roller elements facing each other, together with the geometry of the guide paths results in a kinematically optimal run of the roller elements via the circulating path U. In particular, in using the transport device in casting machines with caterpillar mold, the edges of the cooling blocks do not enter the casting plane when transitioning to the deflection arcs.

In another embodiment, each roller element body includes at least one cooling block so that a casting caterpillar is formed which is suitable as a wall for a casting mold. In this instance, the cooling blocks may be, according to the required operating conditions, made of antimagnetic or ferromagnetic material, preferably copper or aluminum, as well as cast iron or steel.

In yet again another embodiment, the cooling blocks have a bottom side facing the rollers and a flat cooling surface on the opposite side and the two parallel planes including the geometrical axes of the roller axles or of the joint axles are perpendicular to the cooling surface. In the case that the flanks of the cooling blocks are curved, the two planes are defined by the perpendiculars of the edges of the cooling blocks lying in the casting plane, the perpendiculars being vertical to the cooling surface.

In a further embodiment, each roller element includes at least four rollers, wherein respectively two rollers are disposed at the first and second ends of each roller element body, and the rollers disposed at the first end are orthogonally offset to the center plane vis-à-vis the rollers disposed at the second end. In doing so, the advantage can be achieved that the rear rollers of a cooling element are offset in the lateral direction vis-à-vis the front rollers of the adjacent cooling element in such a manner that the cooling elements are able to be pushed together in the direction of motion (in the direction of the circulation movement) until the flanks of the cooling elements touch. Preferably, the two rollers disposed at the first end have a distance A and the two rollers disposed at the second end have a distance B≠A to each other, and the distances A and B are sized so that the two rollers disposed at the first end fit between the rollers disposed at the second end of the adjacent roller element. Thus, the advantage may be provided that the geometrical axes of the rollers of a cooling element disposed at the first end are collinear with the geometrical axes of the rollers of the adjacent cooling element disposed at the second end.

In a further embodiment, the guide paths have at least in one portion of the circulating path U, in which the roller elements would, owing to gravity, fall down from the guide paths, first and second roller running surfaces, which are situated opposite each other.

In a further embodiment, the guide paths have deflection arcs, wherein the guide paths include in the area of the deflection arcs first and second roller running surfaces situated opposite each other in the radial direction so that the rollers roll on the first or the second roller running surface, depending on the direction of the load. The advantage of this embodiment is in that the cooling elements, as a consequence of gravity, are not able to tilt away from the guide paths or fall down therefrom. Preferably, the guide paths respectively include a first and/or second roller running surface directed towards the center plain and a first and/or second roller running surface directed away from the center plane.

In another embodiment, the roller element bodies of the roller elements are designed as cooling blocks and the rollers are attached to the cooling blocks.

In yet another embodiment, the roller element bodies of the roller elements include a roller carrier.

In a further embodiment, a multiple of cooling blocks are situated on each roller carrier perpendicular to the center plane. In doing so, the influences from thermal expansions and stress from cooling blocks and roller carriers (transport carriers) may be minimized to secure the planeness of the casting surface and to reduce the wear of the machine elements caused by thermal stresses. The machine elements unidirectionally impinged with heat have a natural tendency, such as the cooling blocks and the roller carriers placed thereunder, to bend as a consequence of thermal expansions. In order to counteract this circumstance, the beamlike cooling blocks extending over the width of the casting mold have, in the past, been clamped-down onto very flexurally rigid carriers. In a further solution, the cooling blocks are divided into relatively small pieces (cooling block segments), as it is described in the publication U.S. Pat. No. 3,570,586. Since in the second solution mentioned above, the requirement for a flexural rigidity of the carriers over the entire width of the casting surface is omitted, the casting plane may also be built-up laterally by cooling block segments provided with rollers or by a number of individual cooling block carrier elements equipped with cooling block segments and provided with rollers by stringing said segments together in the respectively required width, wherein their heat induced distortions, as a result of their relatively small lateral expansion, may be kept within limits tolerable for the casting process, even in the case of lighter constructions. In this instance, the roller carrier elements may carry one or more cooling blocks. In doing so, roller carriers and cooling blocks laterally pushed together in a gapless manner form the width of the casting plane. In addition to the circumstance that the division of the roller carriers over the width of the casting plane into individual, short roller carrier elements minimizes possible distortions of said carriers, the modular architecture of the casting width is thus also provided.

In a further embodiment, the drive device has at least one driver wheel.

Preferably, the guide paths include at least two deflection arcs, wherein in the area of each deflection arc respectively a driver wheel is disposed on both sides of the center plane. This may achieve the advantage that in the area of the circulating path where the roller carriers are guided on a straight line, the cooling blocks touch at their flanks and, in doing so, push one another when moving.

In another embodiment, the rollers of a roller element, the geometrical axes of which lie on a common straight line, or the mechanical axles of these rollers have extensions perpendicular to the center plane and the driver wheels have recesses on their periphery, which may engage with the extensions. In this embodiment it is advantageous that each roller carrier in each of the two deflection arcs of the guide paths is driven individually by a driver wheel so that in the straight sections of the guide paths, where the driver wheels do not engage with the roller carriers, the trailing cooling block pushes the cooling block in the lead at their common touching surface forward.

In another embodiment, each guide path includes, viewed in a vertical direction parallel to the local gravity vector, an upper and a bottom guide path section, wherein at least the upper guide path section has only one or a multiple of first roller running surfaces. In doing so, the advantage may be achieved that the cooling elements for horizontally situated casting caterpillars on the upper, straight guide path section—respectively, on the upper deflection arc for vertically situated casting caterpillars—may be individually or in assemblies detached from the guide paths or be mounted onto said path. In this area of the circulating path in which the roller carriers naturally do not tilt or fall off the rails because of gravity, the guide paths do not require any counter holding roller running surface.

In yet another embodiment, each guide path includes a deflection arc, which has in a vertical direction parallel to gravity in the upper section a first opening in the second roller running surface oriented towards the center plane and a second opening in the second roller running surface oriented away from the center plane, wherein the distance between the first opening and the second opening measured in the direction of the circulation movement of the roller elements corresponds to the distance, measured in the direction of the circulation movement, of the geometrical axes of the rollers situated at a roller element. The rollers of the cooling element situated in this area of the deflection arc, thus, may be guided through the openings so that the cooling element may be removed from the guide path or be introduced into said path. In doing so, the cooling elements may be simply removed or installed.

In a further embodiment, the transport device has a longitudinal axis and the guide paths are telescopic in the direction of these longitudinal axes so that between adjacent roller elements a space may be created, which enables the removal of a roller element from the guide paths.

Preferably, the roller running surfaces of each guide path have first and second sections moveable relative to each other, which overlap in the direction of the circulation movement.

In another embodiment, the guide paths include respectively a deflection arc mounted in a rotatable manner, wherein the rotatably mounted deflection arcs are symmetrically disposed in respect to the center plane and may be rotated about a rotation axis orthogonal to the center plane.

Preferably, the rotation axis connects the edges of the second roller running surfaces at the connection location between the rotatably mounted deflection arcs and the bottom, straight guide path sections adjacent thereto.

In a further embodiment, respectively a driver wheel is rotatively fixedly attached to a drive axle on each side of the center plane in the area of the deflection arcs of the guide paths, wherein respectively a drive axle is coaxially situated to a geometrical axis of the deflection arcs. In doing so, the advantage may be achieved that the cooling elements in the area of the deflection arcs are driven individually by the driver wheels and are, for this reason, not pressed together in the direction of the circulation movement.

In another embodiment, the roller elements are not coupled to one another in the direction of the circulation movement.

Preferably, the transport device according to the invention is used as a casting caterpillar. In particular, a transport device according to the invention may be used as a base module of a modularly constructed casting caterpillar of a casting machine. In doing so, the advantage may be achieved that the width of the casting surface may be laterally built-up by constructively stringing together identical modules.

BRIEF DESCRIPTION OF THE DRAWINGS

The invention and further refinements of the invention are subsequently described in more detail on the basis of the partially schematic illustrations of a plurality of exemplary embodiments.

DESCRIPTION OF EMBODIMENTS

Figure 1:
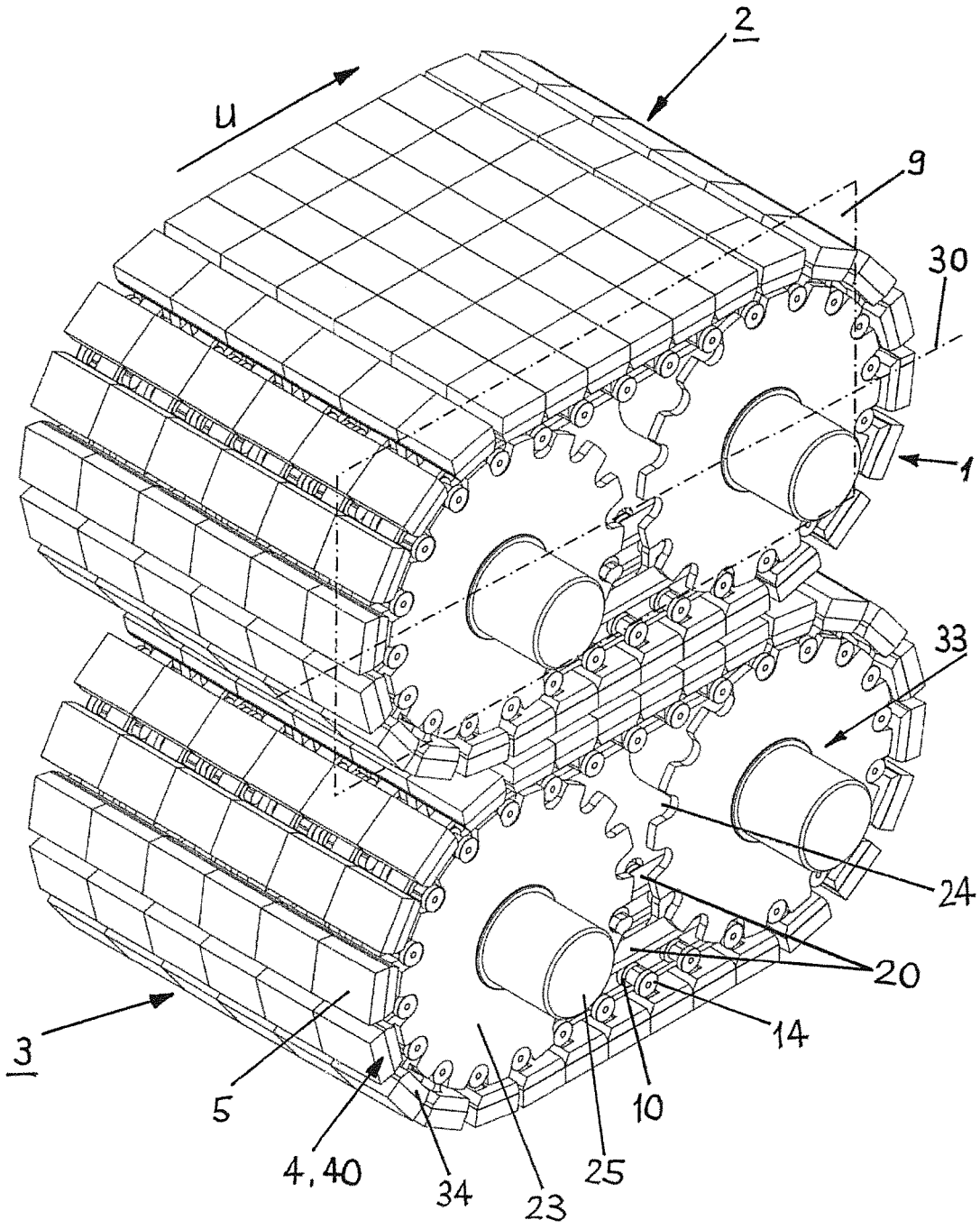
FIG. 1 shows a perspective view of an embodiment of the transport device according to the invention, wherein respectively one transportation device forms a base module of a casting caterpillar of a casting machine.

The transport device 1 according to the invention is here exemplary described in its use in a casting machine with caterpillar mold. In the embodiment illustrated in FIG. 1, the transport device 1 is provided with roller elements 4, whose roller element body 34 includes, for example, a cooling block 5 so that the roller elements 4 form the cooling elements 40 of a casting caterpillar 2, 3. The roller elements 4 designed as cooling elements 40 form the wall of a casting mold on the straight sections of the casting caterpillars 2, 3. Further, the transport device 1 includes a drive device 33 having driver wheels 23 for moving the roller elements 4.

The embodiment illustrated in FIG. 1 includes two casting caterpillars 2, 3, which are positioned horizontally and above one another. Alternatively, casting machines may also be produced having vertically situated or inclined casting caterpillars 2, 3. Each of two casting caterpillars 2, 3 includes, for example, six transport devices 1 positioned next to one another, wherein each transport devices 1 forms a base module 32 of a modularly constructed casting machine. Each transport device 1 includes two guide paths 20, which extend over an oval circulating path U and which are situated symmetrically in respect to a center plane 9. A multiple of roller elements 4 circulate in a caterpillar-like manner on the guide paths 20. Each roller element 4 includes a roller element body 34, which has a first end 35 and a second end 36 in the direction of the circulation movement. Further, at each roller element 4 four rollers 10, for example, are attached. The roller elements 4 are arranged loosely to one another in the direction of the circulation movement, that is, they are not coupled to one another. The circulation movement of the roller elements 4 on the circulating path U may occur in the clockwise direction or in the counterclockwise direction, wherein the roller elements 4 on the first and second casting caterpillar 2, 3 circulate in opposite directions.

Figure 2:
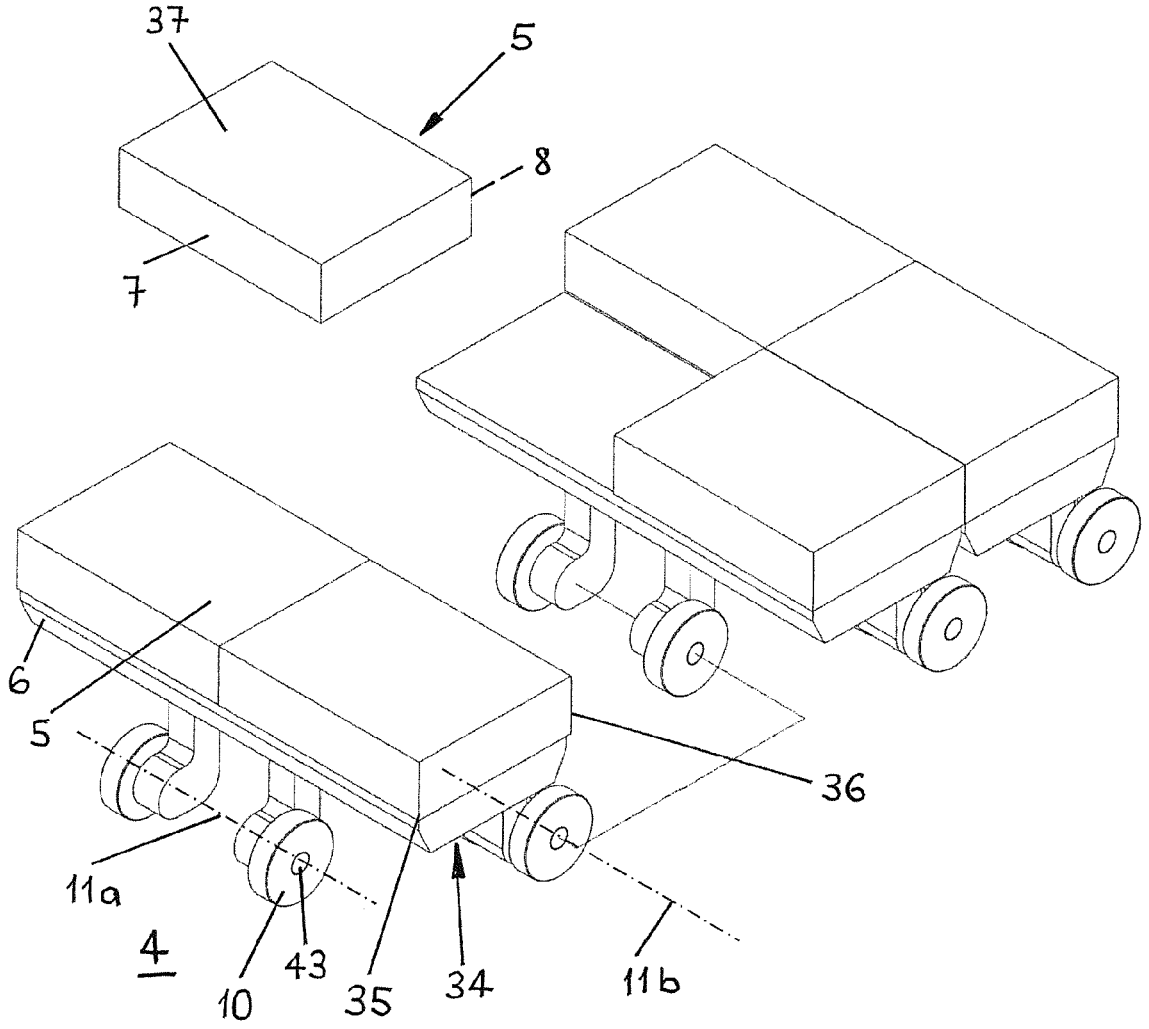
FIG. 2 shows a perspective view of a multiple of roller elements according to the embodiment of the transport device according to the invention illustrated in FIG. 1.
Figure 3:
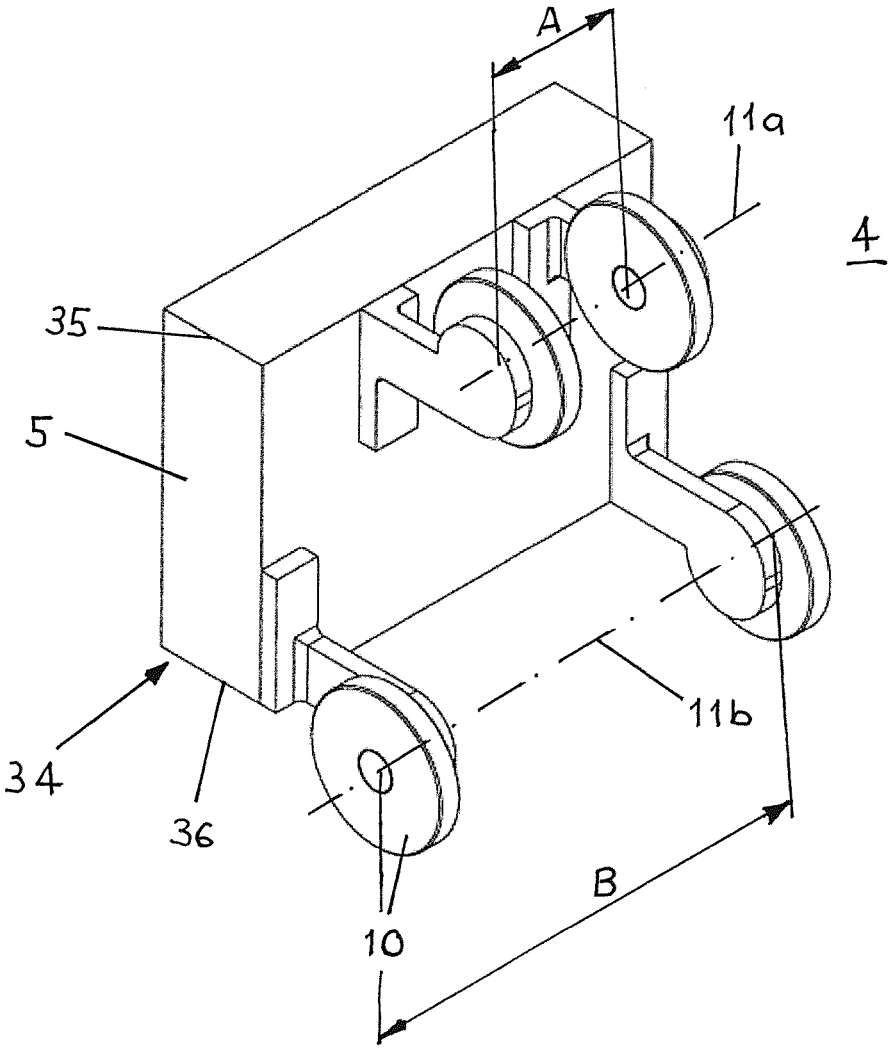
FIG. 3 shows a perspective view of a roller element designed as a cooling element according to another embodiment of the transport device according to the invention.

In the embodiment illustrated in FIG. 2, the cooling blocks 5 are fixed onto individual transport carriers, that is, are not coupled together, which are provided with rollers 10 and subsequently referred to as roller carriers 6. The rollers 10 run on and in guides, which are designed as guide paths 20, so that the roller carriers 6 and the cooling blocks 5 fixed thereon move in a guided and low friction manner on the circulating path U. The cooling blocks 5 may, for example, be releasably attached by screwed connections on the roller carriers 6. Alternatively, the cooling blocks 5 themselves may be provided with rollers 10 (FIG. 3) so that no separate roller carriers 6 are required.

In order to enable an even, undisturbed run of the cooling blocks 5, the rollers 10 attached to each roller carrier 6 are, viewed in the direction of motion, situated in such a manner that their geometrical axes lie on two parallel straight lines 11*a*, 11*b*. Thereby, the first straight line 11*a* is positioned in the area of the first end 35 of the roller element body 34 and the second straight line 11*b* in the area of the second end 36. Preferably, respectively a straight line 11*a*, 11*b* lies in a plane which each is defined by the first and second ends 35, 36 of each cooling block 5. The cooling blocks 5 have a bottom side facing the rollers 10 and, on the opposite side, a flat cooling surface 37 (FIG. 2). For this reason, in cuboidal cooling blocks 37, the first straight line 11*a* lies in the plane defined by front cooling block flank 7 and the second straight line 11*b* lies in the plane defined by rear cooling block flank 8. In cooling blocks 5 tapered toward the rollers 10, both planes are defined by the edges delimiting the cooling surface 37 of a cooling block 5 in the circulation direction and the respective perpendiculars to the cooling surface 37.

Thus, the axle distance of the rollers 10 just corresponds to the cooling block length measured in the direction of the circulation movement. Furthermore, the rollers 10 of the roller carriers 6 situated at the second end 36 are offset in axial (lateral direction) to the casting machine 1 vis-à-vis the rollers 10 of the roller carriers 6 situated at the first end 35 in such a manner that the roller carriers 6 may be pushed together in the direction of motion until the flanks of the cooling blocks 5 touch and, in doing so, the second straight line 11*b*, on which lie the geometrical axes of the rollers 10 of a roller carrier 6 situated at the second end 36, overlaps with that first straight line 11*a*, on which lie the geometrical axes of the rollers 10 of the adjacent roller carrier 6 situated at the first end 35. Each roller 10 of a roller carrier 6 moves along on a guide path of its own. This arrangement together with the geometry of the guide path results in a kinematically optimal run of the cooling blocks 5 via the circulating path U. Each roller carrier 6 has on a straight line 11*a*, 11*b* the geometrical axis of at least one roller 10.

Figure 13:
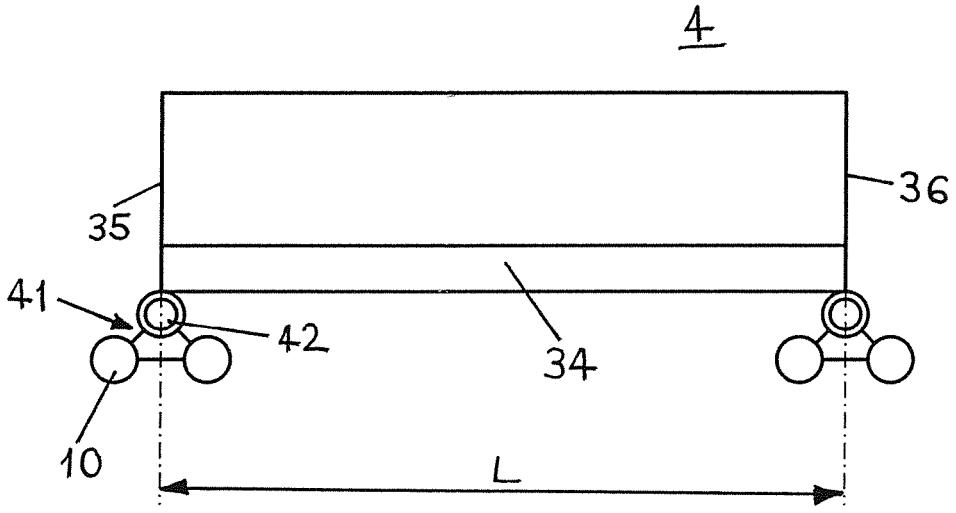
FIG. 13 shows a lateral view of a roller element according to another embodiment of the transport device according to the invention.

In a further embodiment (FIG. 13), the roller elements 4 are designed in such a manner that joint bearings 41 are situated in the area of the first end 35 and in the area of the second end 36 of the roller element body 34 and that respectively at least two rollers 10 are attached at the joint bearings 41. The joint bearings 41 are rotatably attached by way of joint axles 42 at the roller element body 34, wherein the joint axles 42 are situated perpendicular to a center plane 9 defined by the circulating path U (FIG. 1) of the transport device. The geometrical axes of the joint axles 42 of the joint bearings 41 situated in the area of the first end 35 lie respectively in a first plane orthogonal to the direction of the circulation movement, which is defined by the first end 35 of the respective roller element body 34. The geometrical axes of the joint axles 42 of the joint bearings 41 situated in the area of the second end 36 lie respectively in a second plane orthogonal to the direction of the circulation movement, having a distance to the first plane defined by the first end 35 of the respective roller element body 34 which here, for example, is equal to the maximum length "L" of the roller element body 34. The axle distance of the joint bearings 42 here also substantially corresponds to the cooling block length "L" measured in the direction of circulation, as a result of which a kinematically optimal run of the roller elements 4 on the entire circulating path is enabled.

Figure 4:
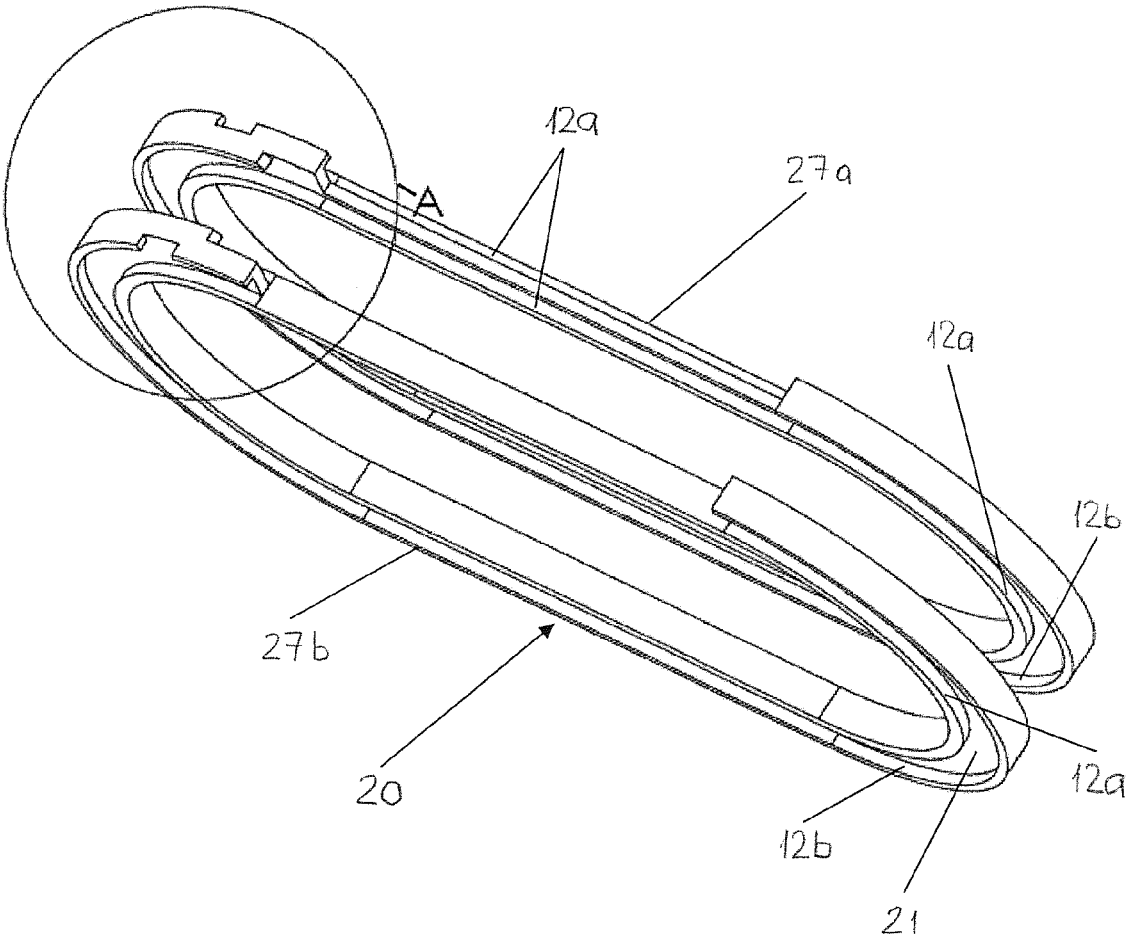
FIG. 4 shows a perspective view of the guide paths according to a further embodiment of the transport device according to the invention.
Figure 5:
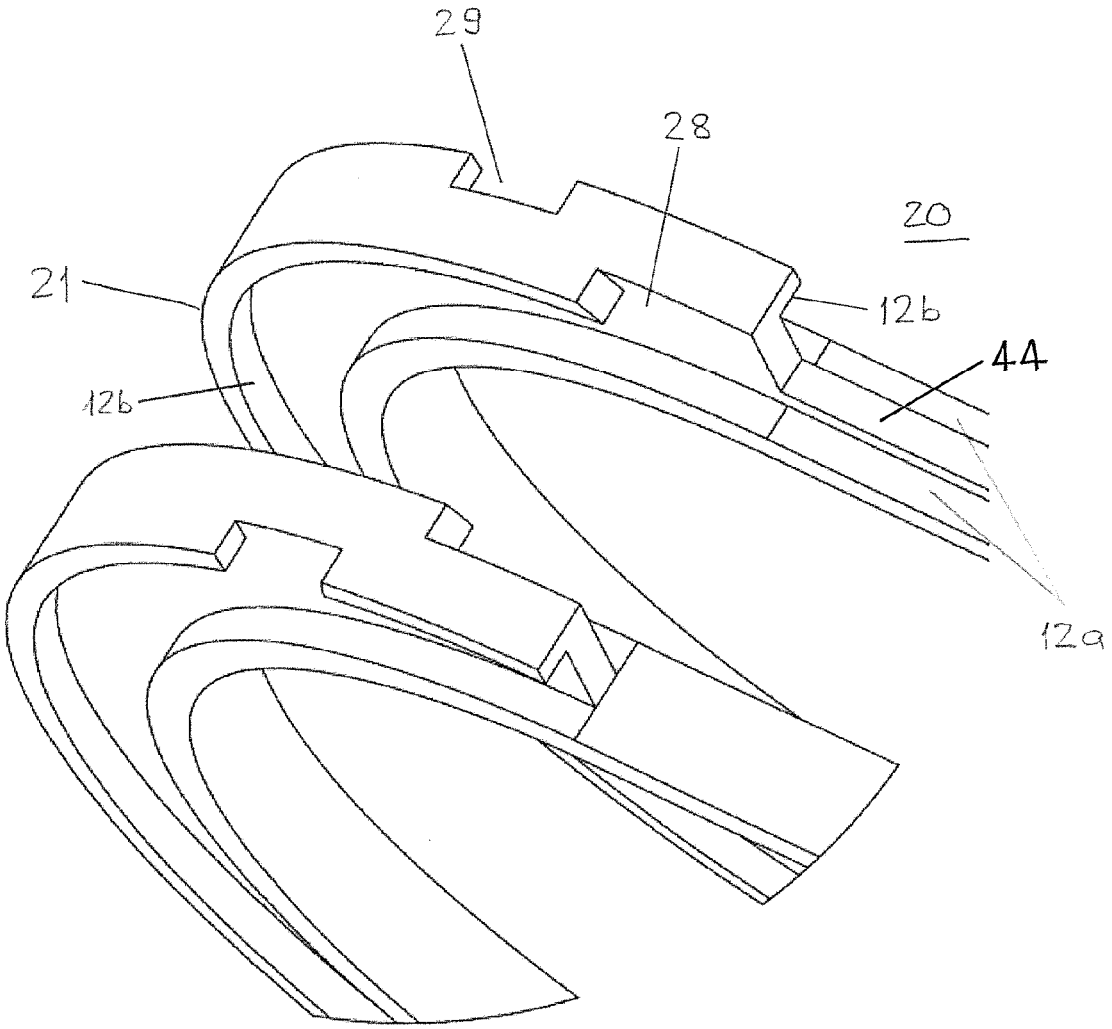
FIG. 5 shows an enlarged illustration of the detail A in FIG. 4.

As can be seen from FIGS. 4 and 5, the roller guides, which are designed as guide paths 20, are designed in the areas of the deflection arcs 21, where the roller carriers 6 as a result of gravity would tilt away from or fall off said arcs, so that they have first and second roller running surfaces 12*a*, 12*b* situated opposite each other, the distance of which is tolerated so that the rollers 10 touch, depending on the direction of the load, on the first or second roller running surface 12*a*, 12*b* and roll thereupon.

Guide paths 20 fulfilling these conditions are preferably designed as profiled rails. Those pairs of rollers 10, the geometrical axles of which sit on the same straight line 11*a*, 11*b*, are mounted in an offset manner opposite each other and run on first and second roller running surfaces 12*a*, 12*b* situated parallel to each other. The guide paths 20 may be designed on one or more profiled rails. In the embodiment illustrated in FIG. 4, each of the two parallel guide paths 20 includes a separate profiled rail and respectively a first and/or second roller running surface 12*a*, 12*b* oriented towards the center plane 9 and a first and/or second roller running surface 12*a*, 12*b* oriented away from the center plane 9. Suitable profiled rails are: U profile for each roller path, U profile having two adjacent running paths, double T profile having respectively one roller running surface 12*a*, 12*b* on the left side and one on the right side of the center bar. Each guide path 20 thus includes respectively at least one roller running surface 12*a*, 12*b* for the rollers 10 situated at the first end 35 of a roller element 34 and for the rollers 10 offset in reference to the center plane 9 at the second end 36 of the same roller element body 34. Alternatively, a profiled rail may include both parallel guide paths 20. Suited for this purpose are profiled rails which are designed as double L profiles, double U profile or also as double T profiles.

In this instance, the two rollers 10 situated at the first end 35 have a distance A (FIG. 3) to each other and the two rollers 10 situated at the second end 36 have a distance B>A to each other, wherein the distances A and B are sized in such a manner that the two rollers 10 situated at the first end 35 fit between the two rollers 10 situated at the second end 36 of the adjacent cooling element 40.

In the area of the deflection arcs 21 of the guide paths 20 driver wheels 23 are mounted, the rotation axis of which concurs with the geometrical axis of the deflection arcs 21. Respectively two driver wheels 23 are symmetrically to the center plane 9 and rotatively fixedly attached onto a drive axle 25, wherein respectively a drive axle 25 is situated coaxially to the geometrical axis of the deflection arc 21. The roller carriers 6 have lateral extensions 14 at one or more of their rollers 10 or roller axles, which engage as drivers, for example, in the form of rollers mounted on the respective axle, into the recesses 24 of the driver wheels 23, which in this manner actuate the roller carriers 6 with their cooling blocks 5.

As illustrated in FIGS. 4 and 5, each guide path 20 includes, viewed in a vertical direction parallel to gravity, an upper and a bottom straight guide path section 27*a*, 27*b*, wherein the upper straight guide path section 27*a* may, in the vertical direction on the same height in relation to the central plane 9, have situated next to one another a first roller running surface 12*a* oriented towards the center plane 9 and a first roller running surface 12*a* oriented away from the center plane 9. In this instance, the first roller running surfaces 12*a* situated next to each other have only at one guide path 20 a guide path section 27*a* provided with a side guide 44 (FIG. 5) so that the cooling elements 40 may expand in the area of the casting mold transversely to the center plane 9.

Applying and removing the cooling blocks 5 together with the roller carriers 6 may be carried out individually or in assemblies. This occurs in the area of the circulating path, where the roller carriers 6 because of gravity naturally do not tilt or fall off the guide paths 20 and which do not require any counter holding second roller running surface 12*b*.

Figure 8:
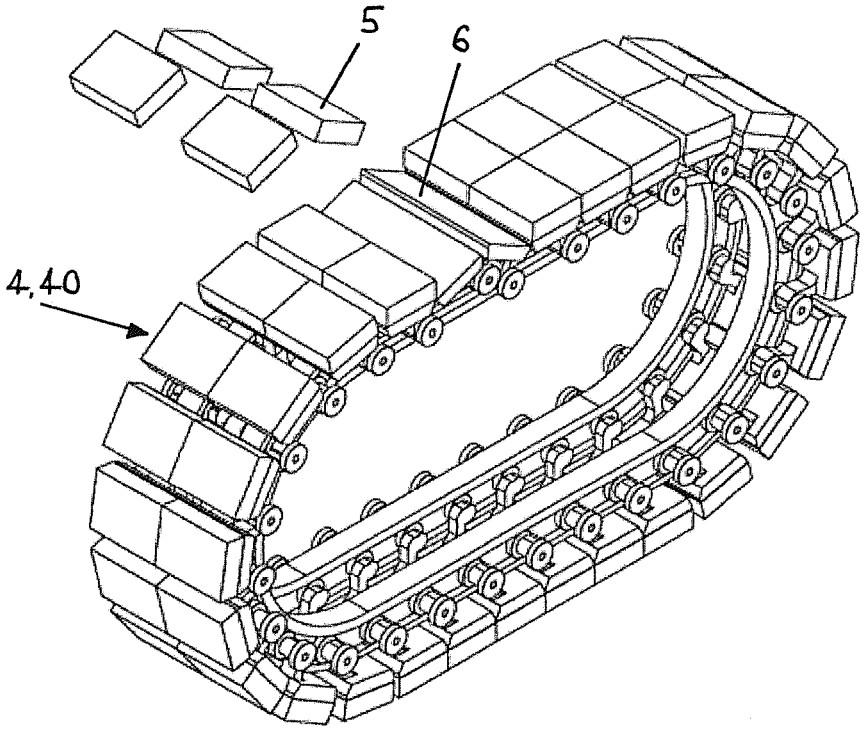
FIG. 8 shows a perspective view of a module of a casting caterpillar according to the in FIG. 1 illustrated embodiment of the transport device according to the invention having partially removed cooling blocks and two tilted roller carriers.
Figures 9, 10:
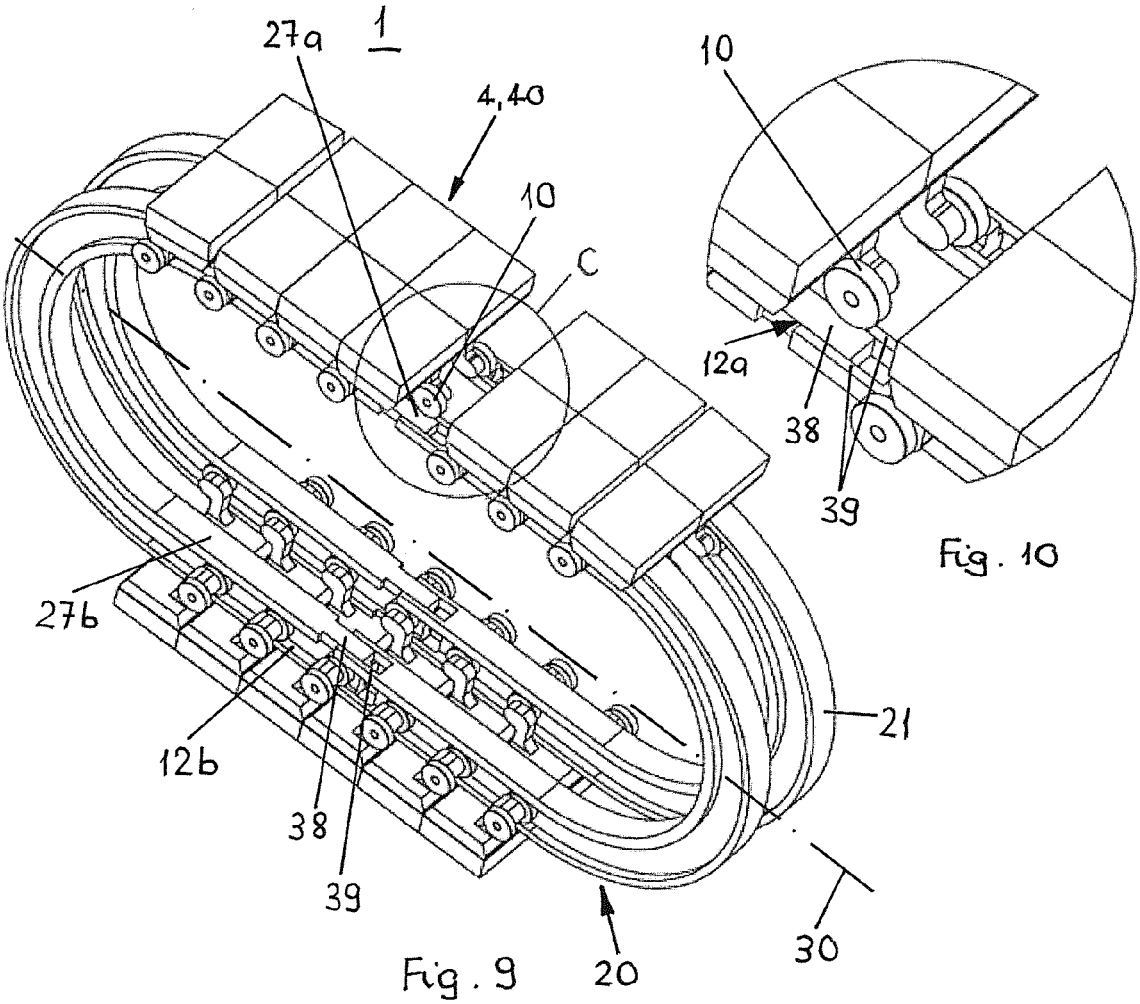
FIG. 9 shows a perspective view of a module of a casting caterpillar according to yet another embodiment of the transport device according to the invention.
FIG. 10 shows an enlarged view of detail C in FIG. 9.

A difficulty, however, results from the kinematic requirement that the distance of the straight lines 11*a*, 11*b* including the geometrical axes of the rollers 10 equates to a cooling block length. The first cooling element 40, which is to be lifted out, gets stuck in the places between the remaining cooling blocks and the cooling block 5 to be removed because the rollers 10 of the cooling element 40, which is to be removed, protrude by half of a diameter under the cooling blocks 5 of the remaining cooling elements 40. Removing a first cooling element 40 may be carried out according to one of the following methods:

1) In case that the cooling blocks 5 are fixed to roller carriers 6 (FIG. 2), it suffices to remove the cooling blocks 5 from two to three successive cooling elements 40, as a result of which the roller carriers 6 may be tilted, pushed together and removed (FIG. 8).
2) In the upper area of the deflection arc 21 (FIGS. 4 and 5), in which the cooling blocks 5 are spread apart, in the area of the rollers 10 higher situated a first opening 28 in the second roller running surface 12*b* and, in the area of rollers 10 situated further below, a second opening 29 in the second roller running surface 12*b* are created, which each have at least the length of a roller diameter. The rollers 10 of the respective cooling element 40 fit through the first and second openings 28, 29 of the two guide paths 20 and enable the removal of the entire cooling element 40. In the embodiment illustrated in FIGS. 4 and 5, the first openings 28 for the rollers 10 situated at the second end 36 having a smaller distance A are located at the second roller running surfaces 12*b* oriented towards the center plane 9 and the second openings 29 for the rollers 10 situated at the first end 35 having a greater distance B are located at the second roller running surfaces 12*b* oriented away from the center plane 9. In the case that the roller elements are arranged in an opposite manner and the rollers 10 situated at the first end 35 have the smaller distance A, the first and second openings 28, 29 are arranged in reversed order.
3) Opening and pushing apart telescopic guide paths 20 in the direction of the longitudinal axis 30 of the transport device 1 results in a gap in the assembly of rows of the cooling elements 40. If the dimension of the gap is equal to at least the diameter of a roller 10, the rollers 10 may be pushed out sufficiently far from below of its adjacent cooling element 40 so to prevent that the rollers 10 interlock with the adjacent cooling elements 40 during extraction. The separation of guide paths 20 may be situated in straight guide path sections 27*a*, 27*b* (FIGS. 9 and 10). The roller running surfaces 12*a*, 12*b* of each guide path 20 have in the direction of the longitudinal axis 30 of the transport device 1 first and second sections 38, 39 movable relative to each other so that the first and second sections 38, 39 of the roller running surfaces 12*a*, 12*b* overlap in the direction of the circulation movement. When the guide paths 20 are pushed apart manner in the direction of the longitudinal axis 30 of the transport device 1, the rollers 10 of the roller elements 4 then rest in the region of the separation location of the guide paths 20 on one of the first or second sections 38, 39 of the roller running surfaces 12*a*, 12*b*.

Figure 11:
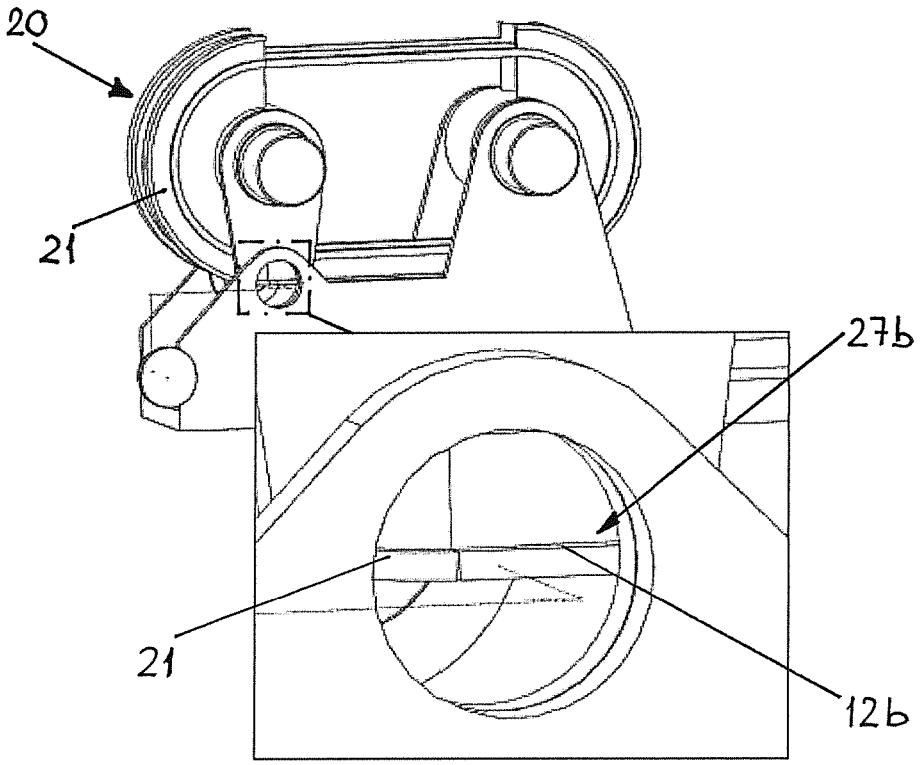
FIG. 11 shows a perspective view of a guide path of a casting caterpillar according to yet again another embodiment of the transport device according to the invention having enclosed guide paths.
Figure 12:
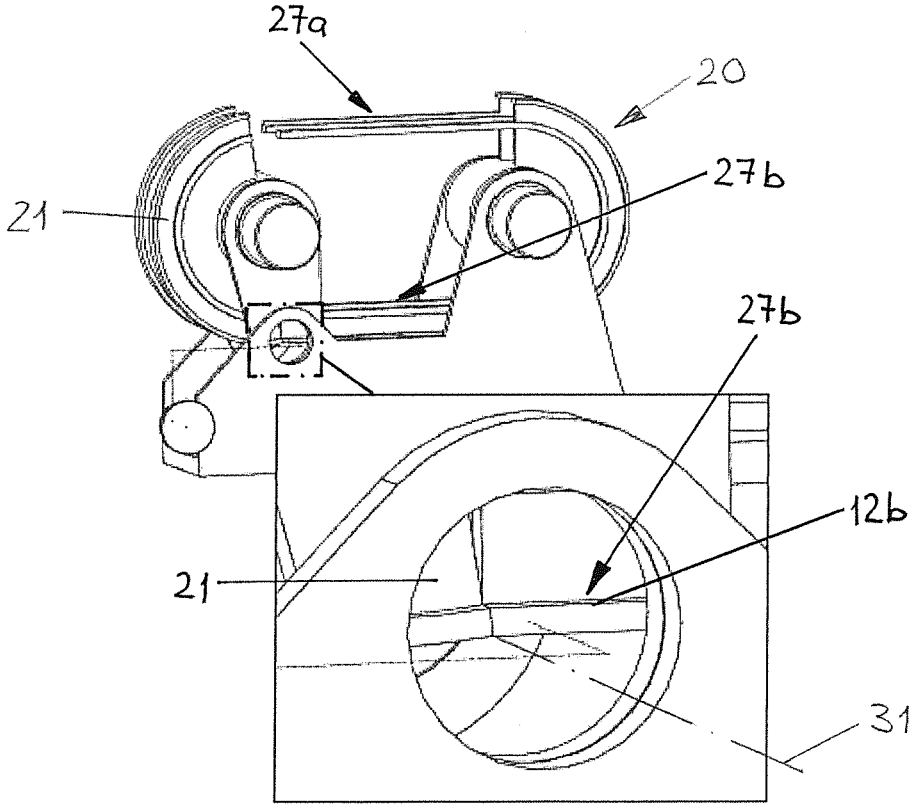
FIG. 12 shows a perspective view of the guide paths of the casting caterpillar according to the embodiment of the transport device according to the invention illustrated in FIG. 11 having open guide paths.

Alternatively, the transition location may, by pushing a deflection arc 21 aside, be opened sufficiently wide between the straight guide path sections 27*a*, 27*b* and the deflection arcs 21 to create the desired gap. In doing so, the deflection arcs 21 may be pushed aside in a translative manner from the straight guide path sections 27*a*, 27*b*, or the deflection arcs 21 may be mounted in a rotatable manner at a rotation axis 31 (FIGS. 11 and 12) connecting the points in which the second roller running surfaces 12*b* of the deflection arcs 21 meet with the bottom second roller running surfaces 12*b* of the straight guide path sections 27*b*. Tilting away the deflection arcs 21 by a respective angle results in the desired path gap at the upper connection location, that is, in that location where the upper straight guide path sections 27*a* meet with the deflection arcs 21 leading downwards. Since the rotation axis is located at the connection location of the second roller running surface 12*b* between the deflection arcs 21 and the bottom straight guide path sections 27*b*, the bottom guide path connections remain gapless during titling so that none of the cooling elements 40 may fall off the guide paths 20.

Figure 6:
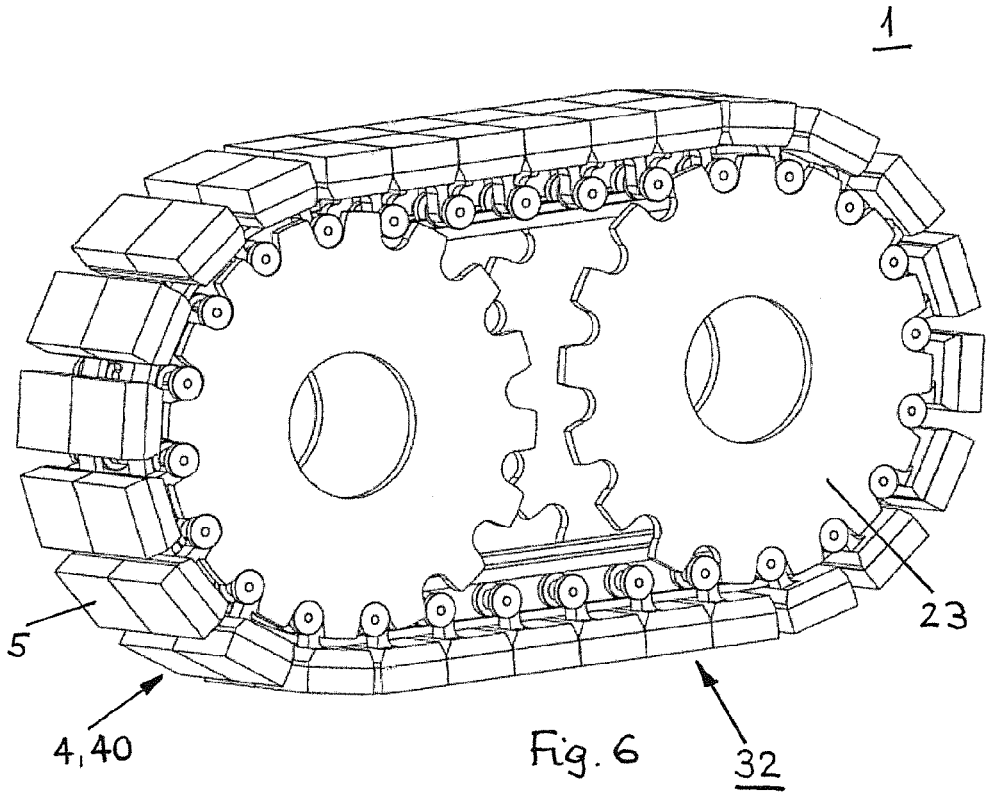
FIG. 6 shows a perspective view of a module of a casting caterpillar according to the embodiment of the transport device according to the invention illustrated in FIG. 1.
Figure 7:
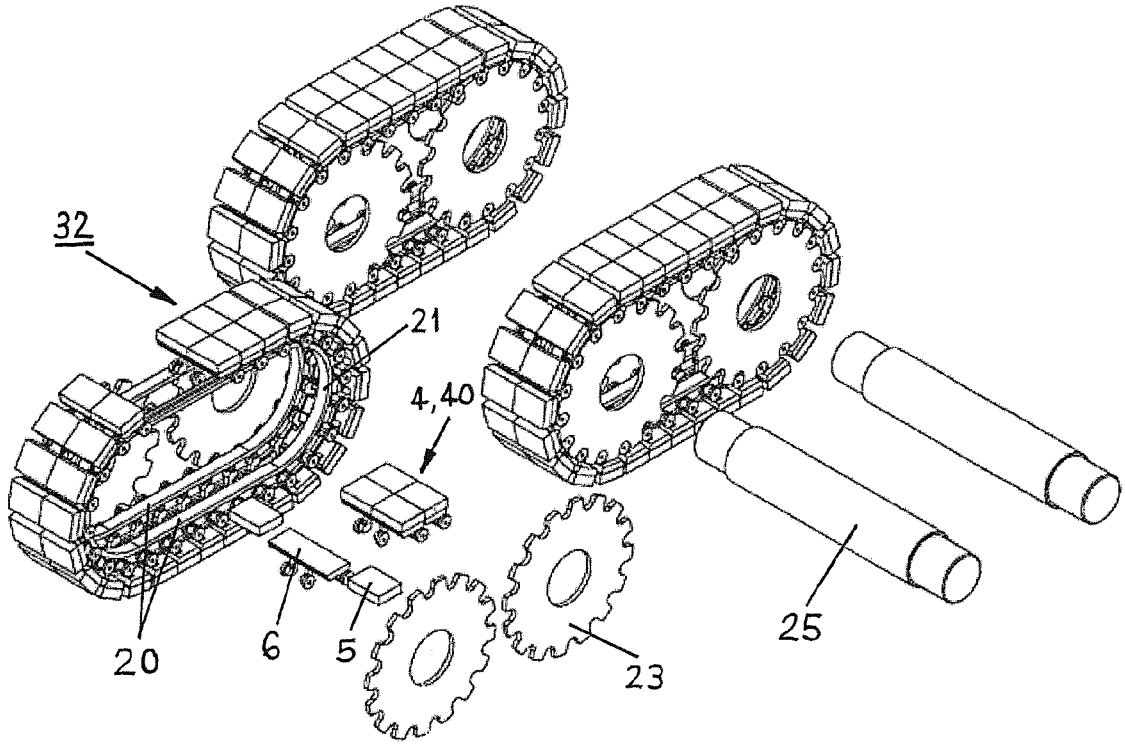
FIG. 7 shows a perspective explosive view of a casting caterpillar including three modules according to the embodiment of the transport device according to the invention illustrated in FIG. 1.

The requirements in reference to the width of the products to be cast are variable and range from under 200 mm to over 2 m. The modular architecture of the casting machines, which meet with the different requirements in respect to the width of the casting product, simplifies the construction, installation and storing of spare parts and creates equal functionality of mechanics and operating requirements across the entire width of the casting plane. In order to setup casting machines having different widths, base module 32 (FIGS. 6 and 7) are configured so that by laterally stringing together said modules casting machines having different casting widths are created.

A base module 32 (FIG. 6) is characterized in that it includes regarding its width a cooling element 40, provided with rollers 10, for example, a roller carrier 6 having one or more cooling blocks 5, deflection arcs 21 and straight guide path sections 27*a*, 27*b*, having that number of roller running surfaces 12*a*, 12*b*, which correspond to the number of rollers 10 of the cooling element 40. To the right and the left of the outer-most deflection arc guides, respectively a driver wheel 23 is positioned in a concentric manner with the deflection arc guides. For this purpose, the driver wheel recesses 24 are oriented in a parallel manner to the axes of the deflection arc guides. Deflection arc guides and driver wheels 23 have in the area of their axes an opening through which a drive shaft 25 may be pushed, whose length is sized so that it is able to receive the number of base modules 32 determining the casting width. A concentric and interlocking connection of the drive shaft 25 with the driver wheels 23 provides their actuation. The driver wheels 23 on their part actuate the roller carriers 6 and the cooling blocks 5 along their circulating path.

As described above, even though different embodiments of the present invention are present, they are to be understood so that the different features may be used individually or in any combination.

For this reason, this present invention is not simply limited to the particularly preferred embodiments mentioned above.

What is claimed is:

1. Transport device for transporting cooling blocks in a casting machine with caterpillar mold, wherein the transport device comprises:

a plurality of roller elements, which endlessly circulate in a caterpillar-like manner on a circulating path U and which are drivable by a drive device;

at least two parallel guide paths, each of which comprises one or more roller running surfaces and extends over the entire circulating path U; wherein each roller element comprises a roller element body, which has a first end and a second end in the direction of circulation; and each roller element comprises in the area of the first end and in the area of the second end respectively at least one roller, wherein the rollers situated in the area of the first end of the roller element bodies roll on roller running surfaces different from those of the rollers situated in the area of the second end of the roller element bodies.

2. Transport device according to claim 1, wherein the roller elements in the direction of the circulation movement are loose relative to one another.

3. Transport device according to claim 1, wherein in the area of the first end and/or in the area of the second end of the roller element bodies joint bearings are situated and respectively at least two rollers are attached to a joint bearing.

4. Transport device according to claim 3, wherein the joint bearings are rotatably attached by way of joint axles to the roller element bodies, wherein the joint axles are situated perpendicular to a center plane of the transport device defined by the circulating path U.

5. Transport device (1) according to claim 4, wherein the roller element bodies measured in the direction of circulation have respectively a maximum length "L" and immediately adjacent roller elements can be positioned on the first and second guide path so that geometrical axes of the roller axles or of the joint axles of the rollers or the joint bearings situated in the area of the first ends of two adjacent roller elements can substantially be adjusted to a distance which corresponds to the maximum length "L".

6. Transport device according to claim 5, wherein geometrical axes of the roller axles or of the joint axles of the rollers or the joint bearings disposed in the area of the second ends lie in a plane orthogonal to the direction of the circulation movement, having a distance to the plane defined by the first ends of the respective roller element body which is substantially equal to or greater than the length "L".

7. Transport device according to claim 5, wherein the cooling blocks have a bottom side facing the rollers and a flat cooling surface on the opposite side, and the two parallel planes comprising the geometrical axes of the roller axles or of the joint axles are perpendicular to the cooling surface.

8. Transport device according to claim 4, wherein geometrical axes of the roller axles or of the joint axles of the rollers or the joint bearings disposed in the area of the first ends lie in a plane orthogonal to the direction of the circulation movement, which plane is defined by the first end of the respective roller element body.

9. Transport device according to claim 1, wherein the rollers comprise respectively a roller axle, wherein the roller axles are fixedly attached to the roller element body.

10. Transport device according to claim 1, wherein geometrical axes of roller axles or of joint axles, which are situated at the first and second ends facing each other of two adjacent roller elements in the direction of the circulation movement, are substantially coaxial.

11. Transport device according to claim 1, wherein each roller element body comprises at least one cooling block so that a casting caterpillar is formed, which is suitable as the wall of a casting mold.

12. Transport device according to claim 1, wherein each roller element comprises at least 4 rollers, wherein respectively two rollers are disposed at the first and the second end of each roller element body, and wherein the rollers disposed at the first end are offset in an orthogonal manner to a center plane vis-à-vis the rollers disposed at the second end.

13. Transport device according to claim 12, wherein the two rollers disposed at the first end have a distance A to each other and the two rollers disposed at the second end have a distance B≠A to each other, wherein the distances A and B are sized so that the two rollers disposed at the first end fit between the rollers disposed at the second end of the adjacent roller element.

14. Transport device according to claim 1, wherein the guide paths have at least in one portion of the circulating path U, in which the roller elements would, owing to gravity, fall down from the guide paths, first and second roller running surfaces, which are situated opposite each other.

15. Transport device according to claim 1, wherein the guide paths have deflection arcs and that the guide paths comprise in the area of the deflection arcs first and second roller running surfaces situated opposite each other in the radial direction so that the rollers roll on the first or the second roller running surface, depending on the direction of the load.

16. Transport device according to claim 15, wherein in the area of the deflection arcs of the guide paths respectively a driver wheel is rotatively fixedly attached to a drive axle on each side of the center plane and respectively a drive axle is coaxially situated to a geometrical axis of the deflection arcs.

17. Transport device according to claim 1, wherein the guide paths comprise respectively a first and/or second roller running surface oriented towards a center plane and a first and/or second roller running surface oriented away from the center plane.

18. Transport device according to claim 1, wherein the roller element bodies of the roller elements are designed as cooling blocks and that the rollers are attached at the cooling blocks.

19. Transport device according to claim 1, wherein the roller element bodies of the roller elements comprise a roller carrier.

20. Transport device according to claim 19, wherein on each roller carrier a multiple of cooling blocks are situated perpendicular to the center plane.

21. Transport device according to claim 1, wherein the drive device comprises at least one driver wheel.

22. Transport device according to claim 21, wherein the rollers of a roller element, geometrical axes of which lie on a common straight line, or mechanical axles of these rollers have extensions perpendicular to the center plane and the driver wheels have recesses on their periphery, which can engage with the extensions.

23. Transport device according to claim 1, wherein the guide paths comprise respectively two deflection arcs and a driver wheel is situated in the area of each deflection arc respectively on both sides of the center plane.

24. Transport device according to claim 1, wherein each guide path comprises, viewed in a vertical direction parallel to the local gravity vector, an upper and a bottom guide path section and at least the upper guide path section has only one or a multiple of first roller running surfaces.

25. Transport device according to claim 1, wherein each guide path comprises a deflection arc, which has in a vertical direction parallel to gravity in the upper section a first opening in the second roller running surface oriented towards a center plane and a second opening in the second roller running surface oriented away from the center plane, wherein the distance between the first opening and the second opening measured in the direction of the circulation movement of the roller elements corresponds, measured in the direction of the circulation movement, to the distance of the geometrical axes of the rollers situated at a roller element.

26. Transport device according to claim 1, wherein the transportation device has a longitudinal axis and the guide paths are telescopic in the direction of this longitudinal axis so that between adjacent roller elements a space can be created which enables the removal of a roller element from the guide paths.

27. Transport device according to claim 26, wherein the roller running surfaces of each guide path have first and second sections movable relative to each other, which overlap in the direction of the circulation movement.

28. Transport device according to claim 1, wherein the guide paths comprise respectively one deflection arc mounted in a rotatable manner, wherein the rotatably mounted deflection arcs are symmetrically disposed in respect to the center plane and are rotatable about a rotation axis orthogonal to the center plane.

29. Transport device according to claim 28, wherein the rotation axis connects the edges of the second roller running surfaces at the connection location between the rotatably mounted deflection arcs and the bottom, straight guide path sections adjacent thereto.

30. Transport device according to claim 1, wherein the roller elements are not coupled to one another in the direction of the circulation movement.

* * * * *